United States Patent [19]

Lenz et al.

[11] 4,174,232

[45] Nov. 13, 1979

[54] METHOD OF MANUFACTURING SHEETS, STRIPS AND FOILS FROM AGE HARDENABLE ALUMINUM ALLOYS OF THE Al-Si-Mg-TYPE

[75] Inventors: Dieter Lenz; Erich Trägner, both of Singen, Fed. Rep. of Germany

[73] Assignee: Swiss Aluminium Ltd., Chippis, Switzerland

[21] Appl. No.: 863,174

[22] Filed: Dec. 22, 1977

[30] Foreign Application Priority Data

Dec. 24, 1976 [CH] Switzerland ..... 16299/76

[51] Int. Cl.[2] ..... C22F 1/04

[52] U.S. Cl. ..... 148/2; 148/11.5 A; 148/12.7 A

[58] Field of Search ..... 148/2, 11.5 A, 12.7 A

[56] References Cited

U.S. PATENT DOCUMENTS

| | | | |
|---|---|---|---|
| 3,032,448 | 5/1962 | Siebel et al. | 148/12.7 A |
| 3,392,062 | 7/1968 | Altenpohl et al. | 148/11.5 A |

*Primary Examiner*—R. Dean

*Attorney, Agent, or Firm*—Bachman and LaPointe

[57] ABSTRACT

A method of manufacture of sheets, strips and foils with high mechanical strength, good deformability, and very little formation of ears, from age hardenable aluminum alloys of the Al-Si-Mg type by continuous casting or strip casting and hot and cold rolling, characterized in that an Al-Mg-Si-alloy is employed, which contains an insoluble excess of silicon at a temperature of 450° to 550° C. usual for homogenization annealing for this type of alloy, this excess remaining in defined finely dispersed form in the matrix, when the alloy is subjected to such a heat treatment; the alloy having preferably a composition corresponding to the area A-B-C-D-A of FIG. 1 of the accompanying drawings, where A=1% Si/0.6% Mg (weight percent), B=1.8% Si/0.6% Mg, C=1.8% Si/0.2% Mg and D=1.2% Si/0.2% Mg, with facultatively additions of a maximum of 0.3% each of chromium, manganese, zirconium and/or titanium.

24 Claims, 2 Drawing Figures

| | %Si | %Mg | °C |
|---|---|---|---|
| E | 1,65 | — | 577 |
| F | 1,16 | 0,68 | 559 |
| G | 1,04 | 0,66 | 550 |
| H | 0,60 | 0,54 | 500 |
| I | 0,24 | 0,28 | 400 |

METHOD OF MANUFACTURING SHEETS, STRIPS AND FOILS FROM AGE HARDENABLE ALUMINUM ALLOYS OF THE Al-Si-Mg-TYPE

BACKGROUND OF THE INVENTION

The present invention relates to a method of manufacture of sheets, strips and foils which are readily deformable and low in ear formation with high strength from aluminum alloys of the type Al-Si-Mg.

It is known that thin sheets of aluminum and of aluminum alloys of medium to high strength are often used in competition with or in combination with tin plate, for cans and can covers, in which connection the most frequent sheet thickness amounts to 0.3 to 0.2 mm and in the course of development is further reduced. This assumes of course that the deformation energy for rolling of the extremely thin sheets remains within economical bounds, and similarly that the durability and strength of the sheets are sufficient and can be used without waste, by good deep drawing properties, especially by fine grain and reliably slight ear formation.

It is furthermore known that these generally established requirements with respect to thin sheet for manufacture of cans have thus far been partly satisfied in various ways. Thus for example tin plate starts by possessing the good strength and deformation properties of iron; but the iron must be protected against corrosion by a layer of tin, which however is exposed at cut edges, and the high natural hardness of the iron requires, as a consequence of the powerful work hardening or the strongly increasing resistance to deformation on cold rolling of thin sheets, a significantly increasing deformation work or deformation energy. Similarly critically, the deformation energy costs increase in cold rolling of thin sheets also with the employment of naturally hard AlMg(Mn)-alloys e.g. for manufacture of can lids with up to 5% magnesium addition. Attempts are made, by numerous graduations of the alloy content, to achieve the always necessary minimum strength with predetermined final thickness more economically, e.g. by avoiding intermediate annealing, but then one almost totally gives up the deformability, or seeks partial solutions, in which concessions are unavoidable as regards strength and in particular also as regards deep drawing properties, particularly in the formation of ears, for example in the manufacture of half-hard can bodies up to 10% edge wastage by reason of ears.

It is known from German Pat. No. 1,184,968 to satisfy the requirements mentioned initially as regards thin can sheets more economically and comprehensively than with AlMg(Mn)-alloys by employment of hardenable aluminum alloys, e.g. of AlMgSi 0.5. There the strength is raised to the level of tin plate by combined cold age hardening and cold working hardening and partial hot age hardening, while the latter is coupled with the baking on of lacquer usual with can sheet, which itself raises the extension at breakage.

The "further important advantages" of the method, put forward in German Pat. No. 1,184,968, namely solution annealing and quenching with already at least twice and preferably so far as three to five times final thickness, and bright rolling of the surfaces with grey annealing skins arising from troublesome pot annealing, identify however an imperfect state of current technique at that time. With the annealing furnaces at present available, free choice was restricted of the optimum conditions for a consequential saving of deformation energy on rolling of extremely thin sheets, and similarly for a desired fine degree of grain without stretching defects and flow marks upon deep drawing, especially however for a minimum formation of ears. With employment of continuous strip furnaces developed in the meantime, the thereby attainable spontaneous highly annealed recrystallisation at about 500° C. solution annealing temperature produces a significantly altered freer choice of optimum preparation requirements; however with AlMgSi 0.5 and other standardised AlMgSi alloys this invariably does not yet lead to sufficient satisfaction of the requirements, which have in the meantime risen further.

This is true particularly of the uniform sliding surface activity of the metal lattice and the consequently resulting minimal formation of ears, necessary for the total employment of the optimum strength and deformability of thin deep drawing sheets. For this purpose further conditions determined by structure are necessary.

Now the purpose of the invention is to achieve this result, with elimination of the defects of the hitherto known methods, by a suitable selection of the alloy composition, and for extreme cases by optimised working conditions for particular processing steps.

SUMMARY OF THE INVENTION

According to the present invention a method of manufacture of sheets, strips and foils with high mechanical strength, good deformability, and very little formation of ears from age hardenable aluminum alloys of the Al-Si-Mg type by continuous casting or strip casting and hot and cold rolling is characterised in that an Al-Mg-Si-alloy is employed, which contains an insoluble excess of silicon at a temperature of 450° to 550° C. which is the normal homogenization temperature range for this type of alloy, this excess silicon being present in a finely dispersed form in the matrix in the said temperature range.

During such a heat treatment, the major part of the silicon contained in the alloy, up to equilibrium at the considered temperature, goes into solution and may be utilised in further hardening processes. Therefore and in analogy with conventional alloys such a thermal treatment at temperatures of 450° to 550° C. is referred thereafter as "homogenization annealing" or "solution annealing" even if the material is not completely homogeneous and still contains silicon heterogenities in very fine dispersion. As explained later in greater detail such a homogenization anneal may be operated for example on ingots before hot rolling or at or near the end of cold rolling, as a part of a hardening process.

The preferred silicon and magnesium content of this alloy is indicated in the accompanying ternary diagram according to FIG. 1 by the area A-B-C-D-A, where A=1% Si/0.6% Mg (weight percent)
B=1.8% Si/0.6% Mg
C=1.8% Si/0.2% Mg
D=1.2% Si/0.2% Mg Prefered ranges for the silicon content are 1.1 to 1.6 or preferably 1.2 to 1.5 weight percent. Further the alloy can, if necessary, contain additions each of a maximum of 0.3 weight percent of chromium, manganese, zirconium and/or titanium.

DETAILED DESCRIPTION

Figure 1:
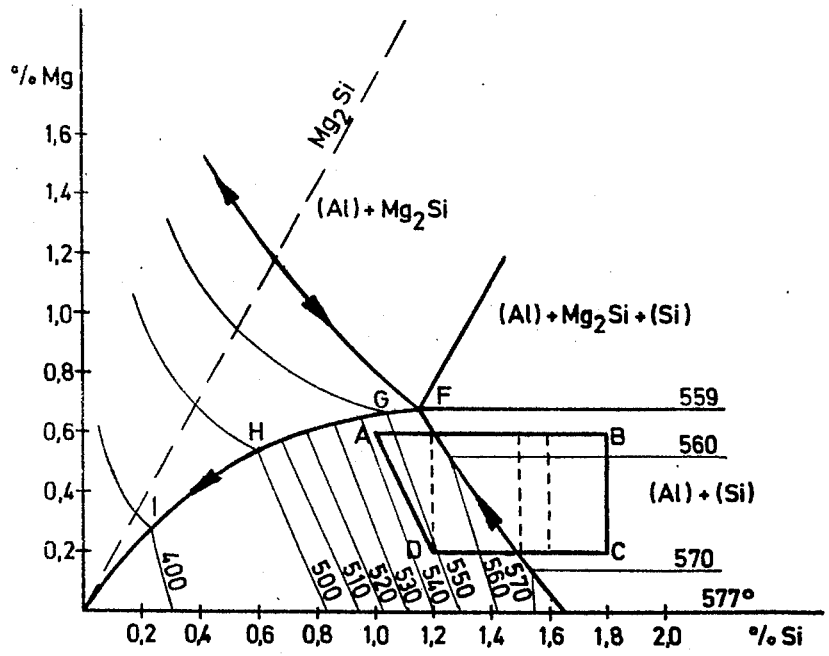
FIG. 1 is the solvus diagram of the Al-Mg-Si-alloys, i.e., the diagram of the solubility in solid condition and is taken from the book METALS HANDBOOK, 8th Edition, Vol. 8, Metallography, Structure and Phase Diagrams, ASM, 1973, page 397, and converted into an orthogonal coordinate system.

It can be seen from the drawings that the alloy zone according to the invention lies between on the one hand the ternary eutectic with corner point F=Si 1.16/Mg 0.68 and the solvus valley running from it, and on the other side the silicon abscissa, this in contrast to the usual Al-Si-Mg-alloys, which generally lie in the neighbourhood of the quasi binary system $Al/Mg_2Si$, in the zone between the solvus valley and the Mg ordinate.

It is further apparent that, for the chosen composition range, after a heat treatment corresponding to a homogenisation annealing at usual temperature of 450° to 550° C., preferably 480° to 530° C., an excess of silicon exists, which does not go into solid solution but remains in the form of very fine dispersion of particles or particulate residue in the matrix.

Figure 2:
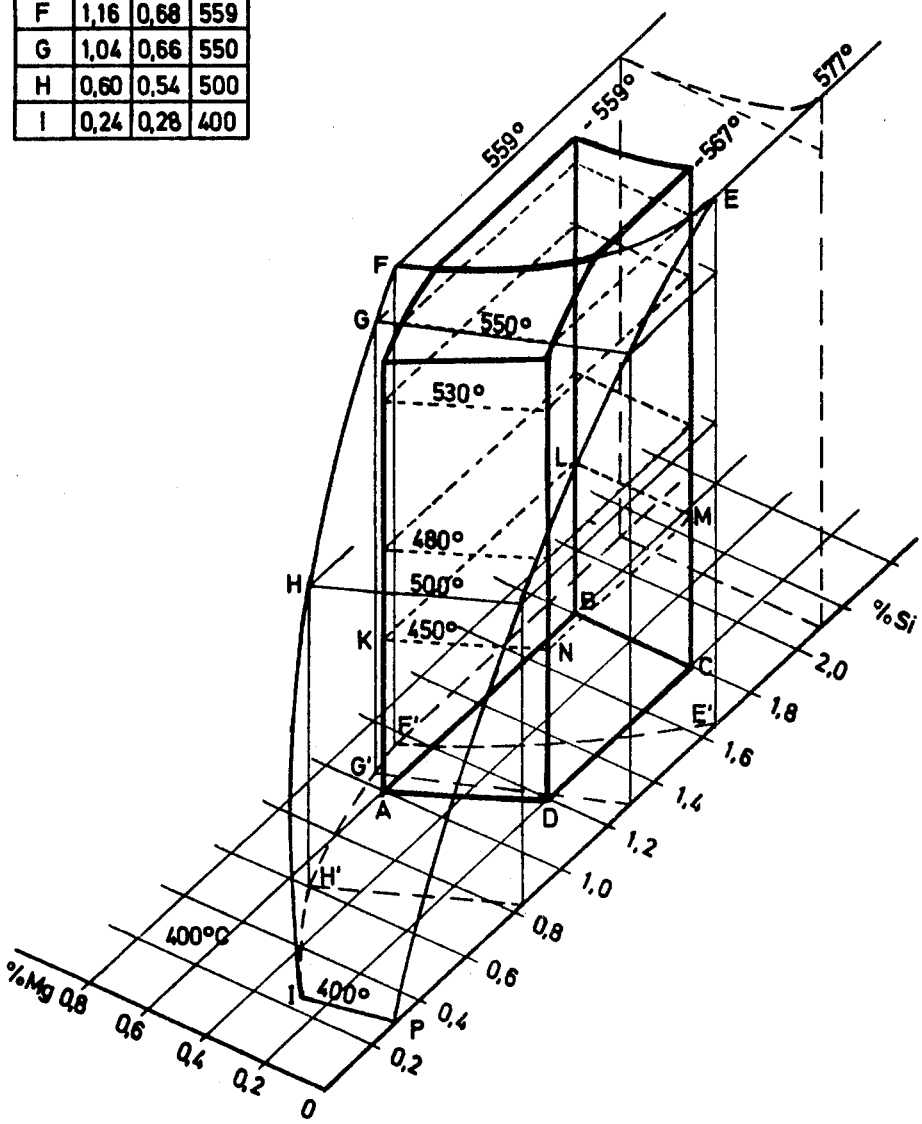
FIG. 2 shows in perspective the spatial arrangement of the area of interest above the isotherm 400° C.

In FIG. 2 the following are also to be noted: for Mg=0 (nil) a part of the binary diagram Al-Si with the point E=Si 1.65/577° C.; then the ternary point F=Si 1.16/Mg 0.68/559° C.; then along the solvus valley the points G=Si 1.04/Mg 0.6/550° C., H=Si 0.6/Mg 0.54/500° C. and I=Si 0.24/Mg 0.28/400° C., and finally the trapezium-shaped boundary planes such as K L M N, at 450° and 550° C. for the zone of the homogenising temperature and at 480° and 530° C. for the preferred zone, with their cooperation with the zone of composition according to the invention.

It is apparent that for the intended supersaturation with silicon the silicon content is limited from below by the bent surface E F G H I P of the solubility boundary in solid condition, in such a way that it is at a spacing from the solubility limit which is valid for the annealing temperature provided. This spacing should correspond to at least 0.1% Si, preferably at least 0.2% Si. Upwards, the silicon content is limited to 1.8% preferably 1.6% or better only 1.5%. With too high a content of silicon, the great excess of silicon leads in undesired manner to coarse heterogenieties, and indeed to a coagulation, with the final consequence that the material exhibits a poor ductility.

The alloy according to the invention is cast in known manner by continuous casting into rolling ingots, or by a strip casting process into strips, while, in consequence of the sudden cooling, finely dispersed precipitates are ensured in the cast structure in the range of above ½2 μm or less, and also a strong supersaturation of the mixed crystals.

The material permits itself to be thereupon hot and cold rolled, possibly with interposition of intermediate annealing. In the homogenizing annealing of the rolling ingots, and possibly of the cast strips and above all of the cold rolled material before quenching and cold or hot age hardening, the most satisfactory formation and effect of undissolved silicon particles in finely dispersed form (the desired heterogenisation) occurs, which favourably influences all structural occurrences, such as crystal formation, even those taking place at lower temperatures. The temperature requirements for the hot rolling, for possible intermediate annealing with cold rolling, as well as for the thermal treatment after the cold rolling, are the same as for conventional Al-Si-Mg alloys. Of course in this connection it is advantageous to keep the time of the homogenization annealing inclusive of the heating-up time as short as possible, so that a coagulation and coarsening of the heterogenieties as well as migration at the grain boundaries can be avoided. Thus the annealing time should not exceed two hours, preferably one hour, better only 30 minutes. The employment of a continuous furnace is particularly suitable, because with it very short periods of annealing of at the most some minutes and even of less than one minute are possible.

In this way sheets can be produced which are particularly suited for deep drawing purposes, and can be used for example as coachwork sheets or for the manufacture of containers.

According to a development of the method according to the invention—above all for manufacture of thin strips, especially for can manufacture, —the rolling ingots or the cast strips are hot rolled to a thickness in the range of 5 to 10 mm and air cooled slowly from the temperature existing at the end of this deformation process; thereupon the material is cold rolled until just before the final thickness, i.e., at 1.1 to 4 times, preferably 1.3 to 4 times the final thickness, it is solution annealed in a continuous furnace at 480° to 530° C., quenched, cold age hardened, and cold rolled to the final thickness. If necessary, the thin strips so produced can then be lacquered by baking, and indeed without any significant loss in strength and hardness.

The described method of operation makes it possible to roll down cold by more than 90% the hot-rolled starting material of 5 to 10 mm thickness with a minimum of deformation energy and even without additional intermediate annealing, which is attributable to the special composition of the material and the internal partly heterogeneous condition.

The described method of operation also, in the manufacture of foils, enables a strength to be achieved corresponding to tin plate, after the solution annealing with subsequent cold age hardening and cold rolling reduction of more than 30%. Moreover the selection according to the invention of the alloy content enables one to combine the good deformability of AlMgSi 0.5 with the strong age hardening of AlMgSi 0.8 or AlMgSi 1, and additionally in the final sheet or foil to achieve an effective measured precipitation in the lattice of uniformly finely dispersed heterogenieties of the order of magnitude of about $5\times10^{-5}$ cm diameter. This surprising uniform heterogenisation with particle sizes in the lower zone of the wavelengths of visible light instead of a coarsening of heterogenieties with increasing amounts of heterogeniety which was to be expected was noted from the colouration of the coating after anodic oxidation in a bath for colour anodising. It can be proved by electron microscopical experiments.

The advantageous action of the uniformly finely dispersed heterogenisation achieved with the composition according to the invention refers both to the action of the slip planes of the metallic crystal lattice during cold rolling and deep drawing, and also to the control of the spontaneous high temperature recrystallisation during the solution annealing in a continuous furnace after preferably especially economical degrees of cold rolling during the pre-rolling, i.e., especially high degrees and also especially to the resulting very little formation of ears in the finished material.

The formation of ears, usually tested by deep drawing of discs (60 mm diameter) with rounded punches (33 mm diameter), is, as is known, determined for conventional alloys in a complex way by material purity and composition, and further by type of casting method, shape of casting, cast annealing, hot rolling conditions, plate annealing and finally by the degree of cold rolling and the number and kind of the recrystallisation annealings employed. Dependably low formation of ears, such as is desired for saving of edge wastage and edging work, but also for increase and waste-free employment of the deformability by uniformly plastic flow of the material during deep drawing, could only be achieved uncertainly as yet.

Thus, e.g. in solution annealing of AlMgSi 0.5 or AlMgSi 0.8 after cold rolling degrees of about 90%, ears of 0.8 to 10% occur at 0°/90° to the direction of rolling and correspondingly different ears also after cold age hardening and cold rolling to a strength corresponding to tin plate. A significant reason is clearly to be seen in the fact that standarised alloys preferably lie in the mixed crystal zone of respective binary and ternary systems, and the complex influences on the formation of ears in homogeneous mixed crystal lattices enhance them reciprocally.

The composition according to the invention, outside the standard, on the contrary aims from the outset at the balancing limitation of these disadvantageous influences on the action of the slipping planes of the metal lattice and on the recrystallisation as well as on the formation of ears with the help of a defined heterogenisation in polynary systems.

The balancing action of the heterogenisation according to the invention in the order of magnitude range of $10^{-5}$ cm, with the mixed crystal work hardening in the atomic lattice range of $10^{-8}$ cm and the grain surface sliding in the range of $10^{-2}$ cm in the plastic deformation of the metal lattice, can be recognised in that neither flow marks occur nor coarse grains, nor such a strong embrittlement as with pure mixed crystal alloys or homogeneous age hardenable alloys of similar strength. The limit of proportionality on extension is relatively high.

The balancing action of the heterogenisation according to the invention, especially with the combined solution annealing and high temperature recrystallisation in a continuous furnace with extremely rapid heating up of about 200° C. per second to over 500° C. and quenching after 10 to 30 seconds annealing period, can be best recognised in the uniform fine grain structure even after extremely high degrees of cold rolling of over 90%, while under similar working conditions AlMgSi 0.5 as a typical homogeneous alloy already shows appreciable grain growth.

The balancing action of the heterogenisation according to the invention on the formation of ears can be employed in conjunction with the uniform fine grain recrystallisation and with the plastic deformation without grains and without flow marks as a directly quantifiable effect, in order to reliably establish a uniformly minimal ear height of about 2% at 0°/90° to the direction of rolling up to about 2% at 45° to the direction of rolling in a gradual transition through zero with 0 to 75% degree of cold rolling after annealing in a continuous furnace at 450° to 520° C. Thus according to the invention a higher state of simultaneous quality requirements for foils is achieved.

EXAMPLE

A strip of aluminum, air cooled after hot rolling, of about 7 mm thickness with 0.4% Mg, 1.3% Si and 0.1% Mn, is cold rolled by about 90% to 0.7 mm thickness without intermediate annealing, and then is solution annealed in a continuous strip furnace at about 500° C., quenched and cold age hardened.

By this treatment the yield point rises from about 5 to 15 kp/mm$^2$, the tensile strength from about 8 to 24 kg/mm$^2$ and Brinell hardness from about 25 to 70 up to 75 kp/mm$^2$. The height of ears after drawing of cups from discs of 60 mm diameter with punches of 33 mm diameter (drawing ratio=60:33=1.82) amounted generally, independently from the preceding degree of cold rolling, to only about 2% at 0°/90° to the directing of rolling.

With subsequent cold rolling to final thickness of 0.2 up to 0.5 mm (cold rolling degree 30 to 70%) the yield point increases to 28 up to 35 kp/mm$^2$, the tensile strength to 30 up to 37 kg/mm$^2$, and the Brinell hardness to 90 up to 120 kp/mm$^2$. With a gradual transition through zero, the ears are, according to the degree of cold rolling, shifted to 1% up to 2% at 45° to the direction of rolling.

During usual baking on of lacquer during 1 to 10 minutes at 150° to 250° C., before the working by deep drawing or inverted drawing or stretching into cans, the strength and hardness are only slightly altered with a simultaneous increase of the extension at break and the deformability. The latter is at an optimum, as a consequence of uniformly good fine grain structure and uniformly finely dispersed lattice heterogeniety and can be used in the saving of wastage, with the help of the slight ears.

What is claimed is:

1. A process for fabricating high strength, improved formability, low earing aluminum strip, sheet and foil from age hardenable aluminum alloys of the Al-Si-Mg type, comprising:

(A) forming an aluminum alloy melt composition consisting essentially of from about 1.0 to 1.8 weight percent silicon, from about 0.2 to 0.6 weight percent magnesium, and the balance essentially aluminum;

(B) casting said alloy in strip form;

(C) hot rolling said cast strip to a first thickness;

(D) cold rolling said hot rolled strip to an intermediate thickness; and (E) annealing said cold rolled strip of intermediate thickness at a temperature of from about 450° C. to about 550° C. so as to provide an aluminum alloy matrix characterized by undissolved, finely dispersed silicon particles whose size is in the lower zone of the wavelengths of visible light so as to obtain good deformability and strong age hardening characteristics.

2. The process of claim 1 wherein said aluminum alloy melt composition comprises from about 1.1 to 1.6 weight percent silicon.

3. The process of claim 1 wherein said aluminum alloy melt composition comprises from about 1.2 to 1.5 weight percent silicon.

4. The process of claim 1 wherein said aluminum alloy melt composition comprises up to 0.3 weight percent chromium, up to 0.3 weight percent manganese, up to 0.3 weight percent zirconium and up to 0.3 weight percent titanium.

5. The process of claim 1 comprising the step of:
cooling said hot rolled strip in air to room temperature prior to cold rolling.

6. The process of claim 1 wherein said annealing time including heat up does not exceed 2 hours.

7. The process of claim 6 wherein said annealing is carried out in a continuous strip furnace.

8. The process of claim 1 wherein said cold rolling to intermediate thickness comprises a reduction of thickness from 1.1 to 5 times final thickness.

9. The process of claim 8 further comprising the steps of:
quenching said annealed strip to room temperature; age hardening said quenched aluminum strip; and cold rolling said age hardend aluminum strip to final thickness.

10. The method of claim 1 further comprising the step of:
lacquering said cold rolled strip of final thickness by baking on.

11. The process of claim 1 wherein said finely dispersed silicon particles are of the order of magnitude of about $5\times10^{-5}$ cm in diameter.

12. A process for fabricating high strength, improved formability, low earing aluminum strip, sheet and foil from age hardenable aluminum alloys including the steps of casting, hot rolling and cold rolling the improvement which comprises:
(A) forming an aluminum alloy melt composition consisting essentially of from about 1.0 to 1.8 weight percent silicon, from about 0.2 to 0.6 weight percent magnesium, and the balance essentially aluminum;
(B) casting said alloy; and
(C) annealing said cast alloy at a temperature of from about 450° C. to about 550° C. so as to provide an aluminum alloy matrix characterized by undissolved, finely dispersed silicon particles whose size is in the lower zone of the wavelengths of visible light so as to obtain good deformability and strong age hardening characteristics.

13. The process of claim 12 wherein said aluminum alloy melt composition is characterized by a silicon content in excess of the solubility limit of said silicon at said annealing temperature, said excess silicon being at least 0.1 weight percent greater than said solubility limit.

14. The process of claim 12 wherein said aluminum alloy melt composition is characterized by a silicon content in excess of the solubility limit of said silicon at said annealing temperature, said excess silicon being at least 0.2 weight percent greater than said solubility limit.

15. The process of claim 1 wherein said anneal precedes said hot rolling.

16. The process of claim 12 wherein said anneal is between said hot rolling and said cold rolling.

17. The process of claim 12 wherein said anneal is subsequent to said hot rolling and said cold rolling.

18. The process of claim 12 wherein said aluminum alloy melt composition comprises from about 1.1 to 1.6 weight percent silicon.

19. The process of claim 12 wherein said aluminum alloy melt composition comprises from about 1.2 to 1.5 weight percent silicon.

20. The process of claim 12 wherein said aluminum alloy melt composition comprises up to 0.3 weight percent chromium, up to 0.3 weight percent manganese, up to 0.3 weight percent zirconium and up to 0.3 weight percent titanium.

21. The process of claim 12 comprising the step of:
cooling said hot rolled strip in air to room temperature prior to cold rolling.

22. The process of claim 13 wherein said finely dispersed silicon particles are of the order of magnitude of about $5\times10^{-5}$ cm in diameter.

23. The process of claim 1 wherein said aluminum alloy melt composition is characterized by a silicon content in excess of the solubility limit of said silicon at said annealing temperature, said excess silicon being at least 0.1 weight percent greater than said solubility limit.

24. The process of claim 1 wherein said aluminum alloy melt composition is characterized by a silicon content in excess of the solubility limit of said silicon at said annealing temperature, said excess silicon being at least 0.2 weight percent greater than said solubility limit.

* * * * *